United States Patent [19]

Kanno et al.

[11] 4,026,647

[45] May 31, 1977

[54] COPY SHEET FEED DEVICE

[75] Inventors: Tadaaki Kanno, Yokosuka; Yuichi Kobayashi, Yokohama, both of Japan

[73] Assignee: Ricoh Co., Ltd., Tokyo, Japan

[22] Filed: Jan. 14, 1976

[21] Appl. No.: 648,870

Related U.S. Application Data

[63] Continuation of Ser. No. 393,341, Aug. 29, 1973, abandoned.

[30] Foreign Application Priority Data

Sept. 1, 1972 Japan ..... 47-87127

[52] U.S. Cl. ..... 355/8; 355/49

[51] Int. Cl.[2] ..... G03G 15/28; G03G 15/24

[58] Field of Search ..... 355/8, 14, 47, 48, 49, 355/50, 51

[56] References Cited

UNITED STATES PATENTS

| | | | |
|---|---|---|---|
| 3,062,095 | 11/1962 | Rutkus, Jr. et al. | 355/14 X |
| 3,604,796 | 9/1971 | Ogawa | 355/14 |
| 3,637,303 | 1/1972 | Komori et al. | 355/8 |
| 3,734,604 | 5/1973 | Szostak | 355/8 X |
| 3,771,866 | 11/1973 | Ogawa | 355/8 X |
| 3,819,261 | 6/1974 | Ogawa | 355/14 |
| 3,836,245 | 9/1974 | Hastwell et al. | 355/8 |
| 3,900,258 | 8/1975 | Hoppner et al. | 355/8 X |

*Primary Examiner*—Edna M. O'Connor
*Attorney, Agent, or Firm*—Cooper, Dunham, Clark, Griffin & Moran

[57] ABSTRACT

A device comprising detection means disposed in a predetermined position on the path of movement of an original scanning system in an electrophotographic copying apparatus for detecting the movement of the original scanning system and producing a signal to actuate a copy sheet feed mechanism of the copying apparatus whereby the leading end of each copy sheet can be brought into index with the leading end of an intermediate image for coordinating the printing of the original image with the scanning thereof.

4 Claims, 6 Drawing Figures

COPY SHEET FEED DEVICE

This is a continuation of application Ser. No. 393,341 filed Aug. 29, 1973, now abandoned.

BACKGROUND OF THE INVENTION

This invention relates to a copy sheet feed device for an electrophotographic copying apparatus.

Methods of forming a duplicate image on each copy sheet by an electrophotographic copying apparatus may be broadly classified into the following according to differences in method steps:

1. A method wherein an optical image of an original formed by means of an optical system is converted into an electrostatic latent image on a photoreceptor including a photoconductive material layer which latent image is developed into a visible image by means of a toner containing developing agent to produce a duplicate of the original;
2. A method wherein a picture signal is recorded as an electrostatic latent image on a recording medium including a dielectric layer by scanning with an electrode, and the latent image is developed into a visible image to produce a duplicate of the original in the same manner as described with reference to paragraph 1;
3. An electrostatic latent image produced as described in paragraphs 1 and 2 is transferred to another recording medium and then developed into a visible image by means of a toner containing developing agent to produce a duplicate of the original; and
4. a method wherein a visible image produced as described in paragraphs 1, 2 and 3 is transferred to paper or other transfer-printing sheet to produce a duplicate of the original.

Various proposals have been made to increase the degree of precision with which copying of an original can be controlled in electrophotographic copying apparatus wherein copying is carried out by the aforementioned methods. One of such proposals is that the photoreceptor of paragraph 1, the recording medium of paragraphs 2 and 3 and the copy sheet or other supporter of the final image (hereinafter referred to as a copy sheet) should be made to carry the image in a position which corresponds to the position of the image in the original, irrespective of the method steps involved.

To attain the end of precluding deviation of the image on the carrier from its correct position, it has hitherto been customary to provide means whereby initiation of movement of an original scanning system, (which is a scanning optical system in the case where the original is stationary and which is a movable original rest in the case where the optical system is stationary) is synchronized to the initiation of feeding of a copy sheet as by successively depressing command switches by a cam rotating at a constant speed to effect control of associated parts. This means has a disadvantage in that, because of its relatively large inertia, the original scanning systm is not necessarily restored to its original starting position or zero point in the strict sense of the term, thereby making it impossible to attain full synchronization at all times.

In order to obviate this problem, improvements should be incorporated in means for moving and stopping the original scanning system so as to increase the degree of precision with which synchronization can be effected. However, this has the disadvantage of a copying apparatus being increased in cost or lowered in reliability in performance due to variations in the precision with which the component parts are finished.

SUMMARY OF THE INVENTION

This invention has as its object the provision of a copy sheet feed device which obviates the aforementioned problem by causing feeding of a copy sheet to be initiated upon detection of the movement of the original scanning system.

This invention is best adapted for use with a type of copying apparatus wherein the original scanning system begins to move prior to initiation of feeding of a copy sheet. It can also have application in copying apparatus wherein, although a copy sheet begins to move earlier than initiation of movement of the original scanning system, the movement of the preceding copy sheet can be checked, in a copying apparatus wherein a copy sheet once fed is made to stand by on its way and made to start moving again in synchronism with initiation of movement of the original scanning system, for example.

DESCRIPTION OF EMBODIMENTS

Embodiments of the invention will now be described with reference to the drawings. In the following description, all the images formed temporarily prior to forming of a final image, or particularly the optical image described in paragraph 1 of the background, the electrostatic latent image described in paragraph 3 or the visible toner image described in paragraph 4 shall all be referred to as intermediate images.

Figure 1:
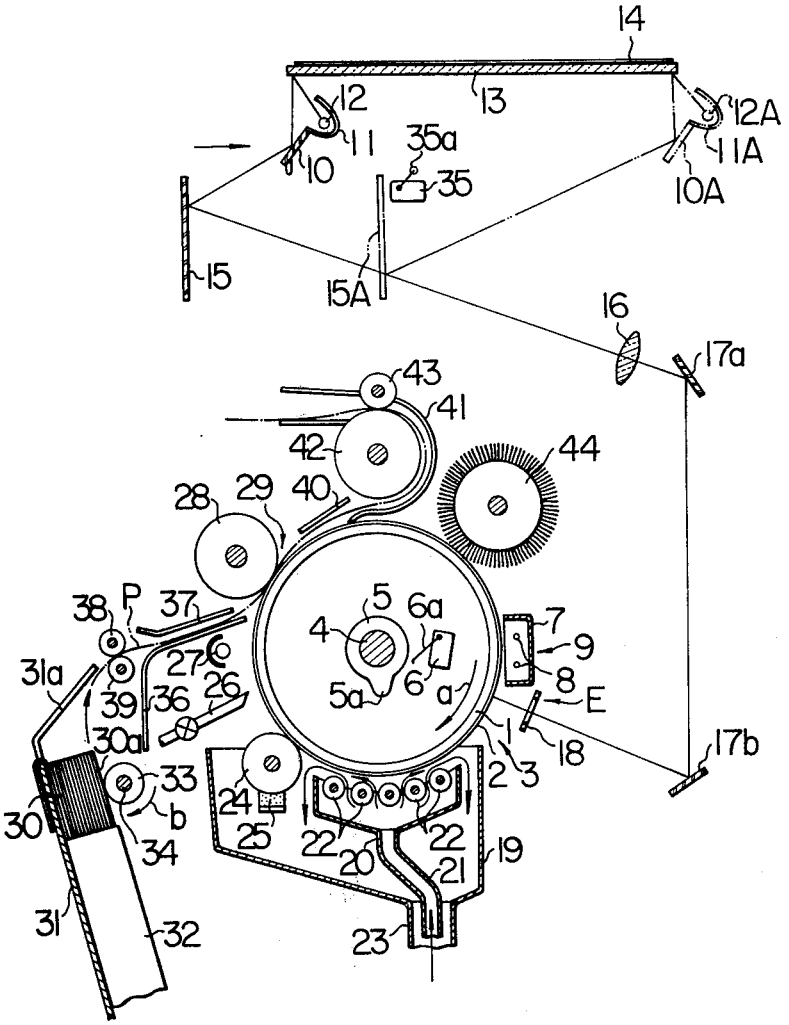
FIG. 1 is a sectional view of one type of electrophotographic copying apparatus in which the invention can be incorporated.

FIG. 1 shows an electrophotographic copying apparatus adapted for continuous operation to carry into practice the electrophotographic copying method described in paragraph 4 above, or particularly the method comprising the steps of exposing an electrically charged photoreceptor to an optical image of the original formed by the scanning optical system to produce an electrostatic latent image of the original, developing the latent image with a liquid developing agent to produce a visible image or intermediate image, and transferring the visible image onto a copy sheet by transfer printing so as to thereby produce a final image of the original.

In FIG. 1, an electrically conducting drum 1 made as of copper, aluminum or the like material is formed on its peripheral surface with a photoconductive material layer 2, such for example as a layer of selenium, zinc oxide or poly-N-vinyl carbazole, to provide a photosensitive drum 3 which is supported by a shaft 4 for rotation at constant rate in the direction of an arrow *a*.

A cam 5 formed with a lobe 5*a* is secured to the shaft 4 for depressing an actuator 6*a* of an actuation instructing switch 6 each time the photosensitive drum 3 makes one complete revolution. A copying cycle is initiated when a print switch (not shown) is manually closed and the switch 6 is closed as mentioned above.

Closing of the print switch and switch 6 supplies a current to a charging device 9 comprising a wire electrode 8 arranged in a shield frame 7, and to a lamp 12 provided at its back with a reflecting shade 11 and attached to a scanning mirror 10. The charging device 9 is disposed rightwardly of the photosensitive drum 3 in FIG. 1 to apply a corona discharge to the photoconductive material layer 2 of the photosensitive drum 3 so as to uniformly charge the entire surface of the layer 2.

The scanning mirror 10 is disposed below a transparent original rest 13 made as of glass or other transparent material which is arranged above the photosensitive drum 3. The mirror 10 is adapted to be controlled as by a timer so that it is connected to drive means (not shown) with the time lag corresponding to lighting of the lamp 12 and moves from an initial position shown in solid lines in FIG. 1 along the original rest 13 to a broken line position 10A together with the reflecting shade 11 and lamp 12 at a rate which is equal to the peripheral velocity of the photosensitive drum 3. The positions of the reflecting shade 11 and lamp 12 are shown at 11A and 12A in broken lines respectively.

The scanning mirror 10 is disposed optically between an original 14 on the original rest 13 and a follower reflector 15 which is perpendicular to the original 14, and reflects the image of the original 14 onto the follower reflector 15 which in turn reflects the image carrying light to a fixed projection lens 16 while moving to a broken line position 15A at a rate which is one-half the rate of movement of the scanning mirror 10. Disposed downstream of the projection lens 16 are mirrors 17*a* and 17*b* and a slit 18 for introducing the light emanating from the projection lens 16 into the photosensitive drum 3 at an exposing station E.

The projection lens 16, original rest 13 and photosensitive drum 3 may be disposed relative to one another such that the optical path length $l$, from the projection lens 16 to the original 14 is equal at all times to the optical path length $l_2$ from the projection lens 16 to the photosensitive drum 3. With such an arrangement an optical image of the original projected by the projection lens 16 is thrown on to the charged photoconductive material layer 2 without increasing or reducing the size of the image. When it is desired to increase the size of the optical image by $n$ times, the end can be attained by setting the ratio of $l$, to $l_2$ at $1:n$, moving the scanning mirror 10 at a rate which is $1/n$ the peripheral velocity of the photosensitive drum and moving the follower mirror 15 at a rate which is equal to $\frac{1}{2}n$ the peripheral velocity of the photosensitive drum 3. It is to be understood that the invention is not limited to the original scanning system shown in FIG. 1 and that any known scanning optical system may be used instead.

When the charged photoconductive material layer 2 of the photosensitive drum is exposed to an optical image of the original, an electrostatic latent image is formed on the layer 2. Mounted below the photosensitive drum 2 in FIG. 1 is a developing pan 20 disposed in a receptacle 19 and juxtaposed with the photoconductive material layer 2. A liquid developing agent is supplied from a tank (not shown) through a pipe 21 to the developing pan 20 and applied as indicated by arrows to the electrostatic latent image through a number of small rollers 22 mounted in the pan 20 so as to develop the latent image into an intermediate visible toner image. After performing the developing operation, the liquid developing agent overflows the developing pan 20 into the receptacle 19 from which it returns to the tank through a pipe 23. A suitable pump (not shown) may be used for returning the liquid developing agent to the tank.

Disposed in the receptacle 19 downstream of the developing pan 20 is a squeeze roller 24 which is maintained in engagement with the photosensitive drum 3 for squeezing excess liquid developing agent, particularly its carrier liquid, from the outer periphery of the drum 3. A cleaner 25 made as of sponge is in contact with the squeeze roller 24 to preclude soiling of the outer periphery of the roller 24 which might otherwise be caused by offsetting of the image. The developing device mentioned above may be replaced by any known means, e.g. a developing device of the dry or wet electrophotographic copying apparatus.

A stream of dry air is blown against the photosensitive drum 3 after excess liquid developing agent is squeezed from the latter by the squeeze roller 24, and then heated by a heater 27 so as to dry the intermediate image to an extent such that it is adapted for transfer printing. Only one of the squeeze roller 24, nozzle 26 and heater 27 or a combination of two of them may be used as drying means, or entirely different known means may be used instead.

Disposed leftwardly of the photosensitive drum in FIG. 1 is a transfer-printing station 29 at which a transfer-printing roller 28 is mounted which is adapted to bring a copy sheet 30 into intimate contact with the outer periphery of the photosensitive drum 3 when the intermediate image on the latter reaches the transfer-printing station 29 so as to form an image on the copy sheet 30 by transfer printing.

The copy sheet 30 which may be made of paper or other suitable material is supplied from a number of sheets piled in a stack in a case 32 mounted on a table 31 disposed leftwardly downwardly of the transfer-printing roller 28. A sheet feed roller 33 is disposed in a position in which it is maintained in pressing engagement with the uppermost copy sheet of the stack of copy sheets 32 in an upper portion of the case in which the sheets are exposed to view.

Figure 3:
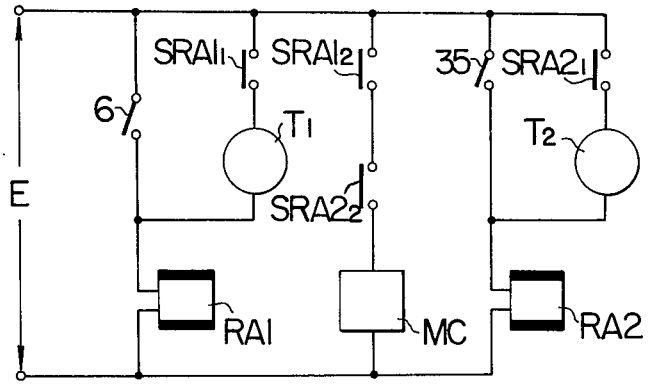
FIG. 3 is a wiring diagram of one example of a circuit for the detection switch.
Figure 5:
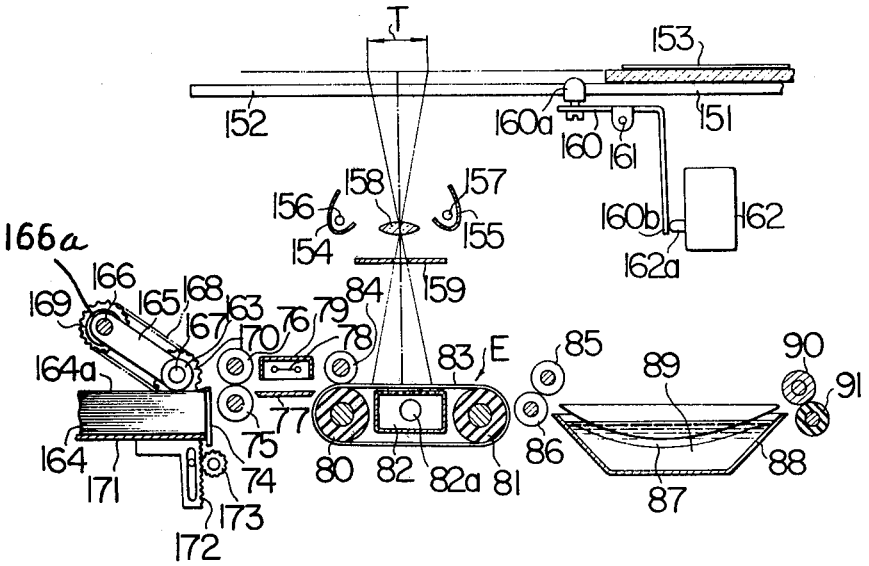
FIG. 5 and FIG. 6 are sectional views of other types of electrophotographic copying apparatus in which the invention is incorporated.

The sheet feed roller 33 is mounted on a shaft 34 which is connected to suitable drive means (such as shown in FIG. 5) as through an electromagnetic clutch (such as shown in FIG. 3) which is engaged upon receipt of a sheet feed command and rotated in the direction of an arrow *b* to perform a sheet feed operation. A sheet feed command is given to the electromagnetic clutch, for example, when an actuator 35*a* of a detection switch 35 of the original scanning system disposed on the path of movement of the scanning mirror 10 is depressed by the mirror 10 to close the switch 35.

When the sheet feed roller 33 rotates upon receipt of a sheet feed command and feeds the uppermost copy sheet 30*a*, the copy sheet 30*a* moves through a sheet passage P defined by a guide plate 31*a*, delivery rollers 38 and 39 and guide plates 37 and 36 before reaching the transfer-printing station.

The mechanisms of the copy sheet feed device according to the invention are constructed such that the time elapsing after the scanning mirror 10 begins its scanning operation till the actuator 35*a* for the detection switch 35 is depessed is set to be equal to the difference between the time required for the leading end of the electrostatic latent image on the photosensitive drum 3 to reach the transfer-printing station 29 after being developed into an intermediate image at an exposing station E and the time the leading end of the copy sheet 30*a* reaches the transfer-printing station 29 after the sheet has left the case 32. By virtue of this feature, the leading end of the intermediate image and the leading end of the copy sheet 30 on which an image is formed by transfer-printing can be brought into perfect alignment with each other, thereby precluding deviation of the image on the printed copy sheet from its regular position. A reed switch or photoelectric transducer element may be used in place of the detection switch as detection means.

The copy sheet 30*a*, on which a final image is formed by transfer-printing from the outer periphery of the photosensitive drum 3 in the transfer-printing station 29, is guided by guide plates 40 and 41 and moved about a discharge roller 42, so that the sheet 30*a* is discharged to outside by a roller 43 cooperating with the discharge roller 42.

Any other known means may be used for feeding a copy sheet to the transfer-printing station and any otherknown construction may replace the construction of the transfer-printing station 29 mentioned above.

When the intermediate image on the outer periphery of the photosensitive drum 3 is transferred to the copy sheet 30*a*, the photosensitive drum 3 is brought at its outer periphery into brushing contact with a cleaning brush roller 44 disposed rightwardly upwardly of the drum 3 in FIG. 1. Thus, the drum 3 has residual toner thereon removed to be ready for the next following transfer-printing operation. The transfer-printing cycle is repeated during the time when the print switch is held for printing the predetermined number of copies, so that the scanning optical system reciprocates for a predetermined number of times and a predetermined number of copy sheets are fed during this time. The detection switch 35 is adapted to have its actuator depressed by the scanning mirror 10 or other original scanning system when the latter reciprocates. A sheet feed command may be avoided, for example, as presently to be described when the original scanning system returns to its starting position.

Figure 2:
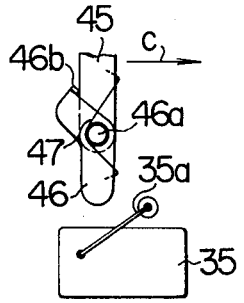
FIG. 2 is a view of detection switch depressing means.

FIG. 2 shows an example in which the actuator 35*a* for the detection switch 35 is kept from being depressed by mechanical means when the original scanning system returns to its starting position. In the figure, a presser 46 is pivotally connected through a shaft 46*a* to an arm 45 to which the original scanning system is secured. A spring 47 of low resilience mounted on the shaft 46*a* is connected at one end to the arm 45 and at the other end to the presser 46 so as to urge the presser 46 to move rightwardly about the shaft 46*a*. The presser 46 is formed with a bent engaging portion 46*b* which is maintained in engagement with the arm 45 to keep the actuator for the detection switch ready to be depressed as shown when no pressure is applied to the presser 46.

When the original scanning system leaves its original position and the arm 45 moves in the direction of an arrow C, the actuator 35*a* for the detection switch 35 is depressed by a right side edge of the presser 46 so as to close the switch 35. However, when the original scanning system returns to its starting position, the presser 46 is brought into contact at its left side edge with the actuator 35*a*, so that the presser is pushed and moved by the actuator, with the result that it moves to the left against the biasing force of the spring and passes by the switch 35 without acting on the actuator 35*a*. Thus the switch 35 is kept from being closed.

FIG. 3 shows an arrangement in which the electromagnetic clutch MC for connecting the shaft 34 of the sheet feed roller 33 to its drive means is electrically controlled as by timers so as to preclude engagement of the electromagnet clutch MC even if the switch 35 is closed when the original scanning system returns to its starting position. In the figure, the electromagnetic clutch MC is connected in series with relay contacts $SRA1_2$ and $SRA2_2$ which are connected in series with other other. A relay RA1 of the relay contact $SRA1_2$ is connected in series with the actuation command switch 6 while a relay RA2 of the contact $SRA2_2$ is connected in series with the detection switch 35. A self-holding contact $SRA1_1$ of the relay RA1 and a first timer T1 connected in series therewith are connected in shunt with the switch 6 while a self-holding contact $SRA2_1$ and a second timer connected in series therewith are connected in shunt with the switch 35.

When the actuation command switch 6 is closed by the cam 5, the relay RA1 is actuated and the contact $SRA1_1$ is closed, so that the timer T1 is actuated and at the same time the relay RA1 self-holds and the contact $SRA1_2$ is also closed. On the other hand, when the detection switch 35 is closed by the original scanning system, the relay RA2 is actuated and the contact $SRA2_1$ is closed, so that the timer T2 is actuated and at the same time the relay RA2 self-holds and the contact $SRA2_2$ is also closed. The timer T1 remains operative from the time the switch 6 is actuated till the time the original scanning system returns near to the switch 35, its circuit being opened immediately before the actuator 35*a* for the switch 35 is depressed. The timer T2 remains operative from the time the switch 35 is closed by the original scanning system till the time a copy sheet is nipped by the rollers 38 and 39, its circuit being opened immediately after the copy sheet is nipped by the rollers 38 and 39. Thus the electromagnetic clutch MC is engaged as the contact $SRA2_2$ is closed when the original scanning system leaves its original position because the contact $SRA1_2$ is closed. However, when the original scanning system returns to its original position, the electromagnetic clutch MC is not engaged even if the contact $SRA2_2$ is closed, because the contact $SRA1_2$ is opened before the contact $SRA2_2$ is closed, so that no copy sheet is fed.

Drive means for the scanning mirror 10 and the following mirror 15 shown in FIG. 1 will now be described with reference to its concrete form. It is to be understood that the invention is not limited to the specific form of drive means shown and described herein and that it may be replaced by any other known construction.

Figure 4:
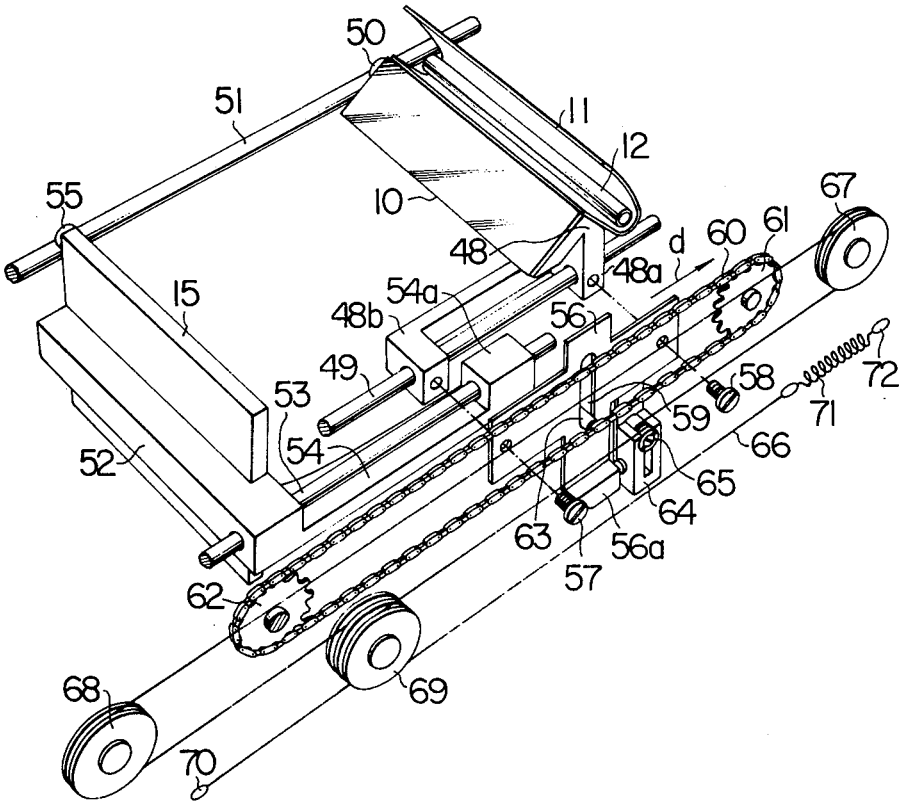
FIG. 4 is a perspective view of the scanning optical system drive means.

In FIG. 4, the scanning mirror 10 is disposed in an inclined position on a first movable member 48 including a lower portion 48*a* and an arm 48*b* loosely fitted over a guide shaft 49 at one end of the member 48. A roller 50 attached to the other end of the member 48 rides on a guide 51.

The follower mirror 15 is secured to a second movable member 52 and juxtaposed with the scanning mirror 10, with the reflecting surface of the former being disposed in a vertical plane. The second movable member 52 is loosely fitted at one end portion over a guide shaft 53. A bearing 54*a* also loosely fitted over the shaft 53 is connected to the second movable member through a connecting bar 54. A roller 55 is mounted at the other end portion of the second movable member 52 and rides over the guide shaft 51.

A guide bar 56 is threadably connected at its opposite end portions to the first movable member 48 by screws 57 and 58 respectively, and formed with a vertically disposed slot 59 at its central portion. A drive chain 60 is arranged outside the guide bar 56 and trained over sprocket wheels 61 and 62. A movable shaft 63 secured to the chain 60 loosely extends through the slots 59. A rotational force adapted to rotate the sprocket wheel 61 clockwise in FIG. 4 is imparted to the sprocket wheel 61, and transmitted to the first movable member 48 through the movable shaft 63 on the chain 60 and the guide bar 56. Thus the movable member 48 moves rightwardly in the figure along the guide shafts 49 and 51.

Secured to the guide bar 56 is a bearing 64 which has fitted therein an adjusting shaft 65 which in turn has a wire 66 wound thereon. One end of the wire 66 is passed through fixed pulleys 67 and 68, trained over a movable pulley 69 and secured to an immovable member 70, and the other end thereof is trained over the movable pulley 69 and secured to another immovable member 72 through a compression spring 71. The movable pulley 69, which is mounted at one side of the second movable member 52 through a shaft, performs the function of moving the second movable member 52. The fixed pulleys 67 and 68 remain stationary as each of them is supported by an immovable member through a shaft.

The sprocket wheel 61 is adapted to drive the scanning optical system shown in FIG. 4 may be connected to its drive means (not shown) as by an electromagnetic clutch. The detection switch 35 may be adapted to be depressed as by a lower end portion 56*a* of the guide bar 56.

When the sprocket wheel 61 is driven, the chain 60 is moved in the direction of an arrow *d* and causes the scanning mirror 10 to move from its original position in a scanning direction together with the movable shaft 63, guide bar 56 and first movable member 48 in slaved relation to the chain 60. At this time, the wire 66 causes the movable pulley 69 to move in the same direction at a rate which is one-half the rate of movement of the scanning mirror 10, thereby causing the second movable member 52 and follower mirror 15 to move in the same direction at the same rate. When the chain has moved half-way through, the mirrors 10 and 15 are moved in an opposite direction toward their original positions. The lower end portion 56*a* of the guide bar 56 may be of any shape. For example, the arm 45 shown in FIG. 2 may be secured thereto so as to cause the presser 46 to depress the actuator 35*a* for the detection switch 35.

The present invention can have application not only in an electrophotographic copying apparatus of the type shown in FIG. 1 but also in an apparatus of the type in which a sheet feed command is given when the original scanning system moves away from its original position and scanning is carried out when the system returns to its original position. In scanning an original, an original rest may be moved instead of moving the optical system as has been described when the copying apparatus in which the invention is incorporated is of a movable original rest type. FIG. 5 shows an example of the device according to the invention in which an original rest 151 is moved when the original is scanned by the optical system. In the figure, the transparent original rest 151 made as of glass or other transparent material is supported on a rail 152 and moves in reciprocating motion from its original position, in which it is shown in the figure, to the left.

An original 153 resting on the original rest 151 is illuminated by lamps 156, 157 having shades 154, 155 at their backs respectively while the original rest moves leftwardly, and an optical image of the original is thrown by a fixed projection lens 158 through a slit 159 onto the exposing station E.

A lever 160 has a portion 160*a* adapted to be depressed which is disposed in the path of movement of the original rest 151 near its starting position. The lever is pivotally supported by a shaft 161 and maintained at a lower end 160*b* of its vertical arm in engagement with an actuator 162*a* of a detection switch 162 by virtue of the weight of the depressed portion at an end of its horizontal arm. When the original rest starts its movement from its original position and depresses the portion 160*a* of the lever 160, the actuator 162*a* is depressed to close the switch 162.

Upon actuation of the detection switch 162, a sheet feed roller 163 disposed leftwardly downwardly in the figure makes one revolution and feeds the uppermost sheet 164*a* of a stack of copy sheets 164 which are photoelectric photosensitive sheets.

To be more specific, the sheet feed roller 163 is supported at a free end of an arm 165 which is pivotally supported by a shaft 166 so as to bring the sheet feed roller 163 into pressing engagement with the copy sheets 164 by its own weight. A chain 168 is trained over gears 169, 170, the gear 169 being supported by a shaft 166 supporting the arm 165 and the gear 170 being supported by a shaft 167 supporting the sheet feed roller 163. An electromagnetic clutch 166*a* is interposed between the gear 169 and the shaft 166 and is connected to drive means (not shown), so that it is possible to rotate the sheet feed roller 163 by controlling the electromagnetic clutch 166*a* by the detection switch 162.

The copy sheets 164 are piled in a stack on a sheet feed tray 171 and adapted to be moved upwardly at suitable times by a rack 172 and pinion 173 arrangement so that the uppermost sheet may be maintained in pressing engagement with the sheet feed roller 163 at all times. The sheet feed roller 163 cooperates with a pair of separators 74 (only one is shown) keeping down opposite sides of the leading ends of the copy sheets so as to successively feed one sheet after another from the top of the pile of copy sheets 164.

A copy sheet 164*a* fed by the sheet feed roller 163 in cooperation with the separators 74 is delivered by a pair of delivery rollers 75 and 76 to a guide plate 77 on which it is subjected to a corona discharge applied by a charging device comprising a wire electrode 78 and a shield frame 79 so that the entire surface of the copy sheet 164*a* is uniformly charged.

At the exposing station E, a number of endless belts 83 are trained over rollers 80 and 81, and a suction box 82 is disposed between upper runs and lower runs of the belts 83. The belts 83 move while their upper runs move horizontally so as to convey the copy sheet 164 at a rate which is consistent with the rate of movement of the original rest 151. A roller 84 is maintained in pressing engagement with portions of the upper runs of the belts 83 at which the roller 80 is disposed to facilitate feeding of the copy sheet 164. The suction box 82 is formed at its top wall with a number of suction openings and at one side with an opening 82*a* through which air is drawn by suction by means of a pump (not shown) so as to draw the copy sheet on the belts 83 toward the belts 83 by suction. Thus the copy sheet is completely planar when it is disposed on the upper runs of the belts 83.

In this embodiment, the time elapsing after the original rest actuates the detection switch 162 till the leading end of the original 153 enters a scanned region T is equal to the time elapsing after the detection switch 162 is closed till the leading end of the copy sheet enters the exposing station E following reception of a command to feed a copy sheet from the detection switch by the copy sheet feed roller 163 which then feeds the copy sheet. As a result, the copy sheet 164 coincides with the portion of the photoconductive layer of the drum on which an optical image of the original is formed as an intermediate image, and the image formed finally on the copy sheet never deviates from its correct position, even if the starting position of the original rest 151 deviates from its regular position.

The copy sheet 164 on which an electrostatic latent image is formed in the exposing station E moves between rollers 85 and 86 and is guided by guide fins 89 in moving through a developing tank 88 containing a liquid developing agent 87 therein. While the copy sheet 164 moves through the developing tank, the electrostatic latent image thereon is developed. Then the copy sheet 164 moves between squeeze rollers 90 and 91 before being discharged to outside.

Figure 6:
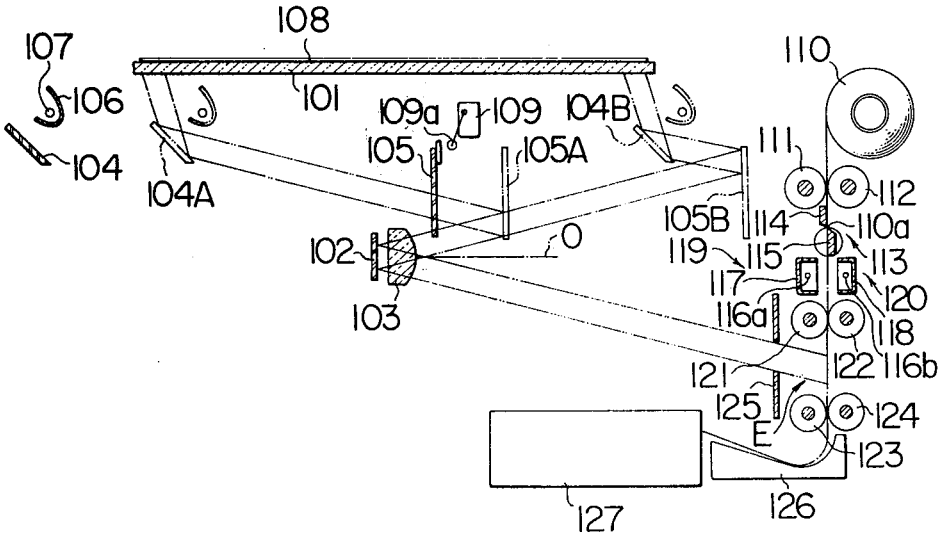

Still another embodiment of the invention will now be described with reference to FIG. 6 in which a projection lens 103 having a reflector 102 disposed at its back to act as a unit therewith is disposed below a transparent original rest 101 made as of glass or other transparent material. The projection lens 103 has an optical axis O which is parallel to the rest 101.

A scanning mirror 104 and follower mirror 105 are disposed between the original rest 101 and projection lens 103, with the scanning mirror 104 being juxtaposed with the original rest 101 and follower mirror 105 and adapted to move from its starting position in the figure rightwardly at a constant rate and with the follower mirror 105 being juxtaposed with the scanning mirror 104 and projection lens 103 and adapted to move in the same direction as the scanning mirror 104 at a rate which is one-half the rate of movement of the scanning mirror 104. The mirrors 104 and 105 may be moved by the drive means shown in FIG. 4.

The scanning mirror 104 has attached thereto a lamp 107 having a shade 106 at its back and adapted to move with the scanning mirror 104 as a unit. Scanning of an original 108 by the scanning mirror 104 is initiated when the mirror 104 is disposed immediately beneath an end portion of the original 108 resting on the original rest 101 or in a position designated 104A.

A detection switch 109 has an actuator 109*a* which is disposed on the path of movement of the follower mirror 105 in a position which is near its starting position. The follower mirror 105 depresses the actuator 109*a* till it reaches a scanning initiation position 105A, so as to close the detection switch 109. A roll of photosensitive strip 110 is disposed rightwardly of the original rest 101 in FIG. 6. A forward end portion 110*a* of the strip 110 is nipped by sheet feed rollers 111 and 112 and its leading end is interposed between a fixed blade 114 and a rotary blade 115 of a cutter 113.

When the detection switch 109 is closed by the follower mirror 105, the feed rollers 111 and 112 begin to rotate and cause the leading end portion 110*a* of the photosensitive strip to pass between two charging devices 119 and 120 comprising wire electrodes 116*a*, 116*b* and shield frames 117, 118 respectively. The leading end portion of the photosensitive strip 110 is then nipped by a pair of rollers 121 and 122 after being charged.

Disposed downstream of the pair of rollers 121 and 122 is another pair of rollers 123 and 124 which cooperates with the pair 121 and 122 to tension the forward end portion 110*a* of the photosensitive strip 110 in an exposing station E. The pair of rollers 121 and 122 feed the forward end portion 110*a* at a rate equal to the rate of movement of the scanning mirror 104. At the exposing station E, the forward end portion 110*a* is exposed to an optical image of the original 108 thrown by the projection lens 103 through a slit 125. In this emodiment, the time elapsing after the follower mirror 105 begins to move and the detection switch 109 is closed till the mirror 105 reaches the scanning initiation position 105A is equal to the time elapsing after the forward end portion 110*a* of the photosensitive strip 110 is begun to be fed by the rollers 111 and 112 till it is introduced into the exposing station E. Thus the leading end of the optical image which is an intermediate image coincides with the leading end of the forward end portion 110*a* of the strip 110.

After being exposed to the optical image, the forward end portion 110*a* is introduced through a guide plate 126 into a developing device 127 and cut at its trailing end by the cutter 113 at a suitable time. An electrostatic latent image formed on the severed portion of the strip 110 by exposure to the optical image is developed into a visible image, and the severed portion is discharged to outside. On the other hand, the scanning mirror 104 and follower mirror 105 return to their starting positions from turn-back positions 104B and 105B respectively shown in FIG. 6.

What is claimed is:

1. A copying apparatus for performing a duplicating operation on an original document comprising:

a. an original document scanning means for scanning and transmitting an image of an original document to be duplicated, said scanning means comprising movable means for reciprocal movement along a scanning path defined by the limits of image transmission;

b. receptor means for receiving said transmitted image and producing an intermediate image of the original document in response thereto, said receptor means comprising an endless surface moving cyclically along a fixed path continuously at a predetermined rate during the duplicating operation, on which surface said intermediate image is produced;

c. a copy sheet feed means for presenting copy sheets to said surface containing said intermediate image in order to transfer said intermediate image of said original document onto said copy sheets;

d. detection means disposed in a predetermined position along the scanning path of said movable means, for detecting the movement of said movable means past the predetermined position and for producing a detection signal in response thereto; and e. means for actuating the copy sheet feed means in response to said detection signal; and wherein said predetermined position is set along the scanning path of said movable means such that the detection signal is synchronized to cause said copy sheet feed means to feed the leading end of each copy sheet to said surface in coincidence with the leading end of the intermediate image.

2. Apparatus as in claim 1 wherein said original document scanning means is a slit-exposure optical system and said movable means comprises means for moving said original document.

3. Apparatus as in claim 1 wherein said detection means comprises a switch having an actuator disposed in the path of said movable means so as to be depressed thereby.

4. Apparatus as in claim 1 wherein said actuating means comprises:

a. an electromagnetic clutch means for drivingly engaging said copy sheet feed means; and b. a control circuit including:

i. a first relay and a first timer arranged in series with each other and in parallel with said electromagnetic clutch means;

ii. a switch means actuated by said receptor means for actuating said first relay and timer;

iii. a second relay and a second timer arranged in series with each other and in parallel with said electromagnetic clutch means and said first relay and first timer, and connected to said detection means for actuation thereby; and iv. respective contacts of said first relay and said second relay connected in series with said electromagnetic clutch means.

* * * * *